US006381876B2

(12) United States Patent
Krajcir

(10) Patent No.: US 6,381,876 B2
(45) Date of Patent: May 7, 2002

(54) METATARSAL PROTECTORS FOR FOOTWEAR

(76) Inventor: Dezi A. Krajcir, 330 Ramsay Dr., Dunnville, Ont (CA), N1A 2X1

( * ) Notice: Subject to any disclaimer, the term of this patent is extended or adjusted under 35 U.S.C. 154(b) by 0 days.

(21) Appl. No.: 09/785,253

(22) Filed: Feb. 20, 2001

Related U.S. Application Data

(63) Continuation-in-part of application No. 09/517,556, filed on Mar. 2, 2000, now abandoned.

(51) Int. Cl.[7] ..... A43B 13/22
(52) U.S. Cl. ..... 36/72 R; 36/77 R; 36/96
(58) Field of Search ..... 36/72 R, 77 R, 36/77 M, 96, 107, 131, 136, 71

(56) References Cited

U.S. PATENT DOCUMENTS 3,102,347 A * 9/1963 Griswold et al. ..... 36/72 R
3,175,310 A * 3/1965 MacQuaid ..... 36/72 R
3,561,142 A * 2/1971 Streit, Sr. et al. ..... 36/72 R
3,841,004 A * 10/1974 Gray et al. ..... 36/72 R
3,997,983 A * 12/1976 Terhoeven ..... 36/72 R
4,231,170 A * 11/1980 Griswold ..... 36/72 R
4,342,159 A * 8/1982 Edwards ..... 36/77 R
4,574,497 A * 3/1986 Jindra ..... 36/77 R
4,908,963 A * 3/1990 Krajcir ..... 36/77 R
5,701,688 A * 12/1997 Crowley ..... 36/72 R
5,809,666 A * 9/1998 Hardwood ..... 36/77 R
6,079,125 A * 6/2000 Quellais et al. ..... 36/25 R
6,161,313 A * 12/2000 Bisson ..... 36/72 R

* cited by examiner

*Primary Examiner*—M. D. Patterson
*Assistant Examiner*—Jila M. Mohandesi
(74) *Attorney, Agent, or Firm*—Stanley J. Rogers

(57) ABSTRACT

A metatarsal protector for footwear consists of a body molded from resilient plastics material, thus facilitating walking and kneeling, the material being sufficiently flexible that it can be molded flat and bent to the required saddle shape when it is incorporated into the footwear close against the upper inner surface. The range of hardness required for the material is comparatively narrow, so that it is sufficiently flexible, but can still meet certification requirements, and as measured by a Durometer A test is between 35 and 50 Shore. The protector comprises a plurality of integral ridged projections protruding from one surface, forming between themselves a corresponding plurality of open-mouthed recesses, each of which is surrounded by a single projection (e.g. giving a circular recess) or by a plurality thereof intersecting one another (e.g. giving rectangular or triangular recesses). When an impact force is applied to the metatarsal region the resilient material deforms and absorbs the force. The projections may be more closely spaced at and around the usual impact point. Preferably, the body is provided on the opposite surface with second projections, each of which registers with a respective recess at the first surface, and is the same shape and size, or slightly smaller, so that on deformation the second projections to enter their respective recesses, increasing the impact absorption. It has been found unexpectedly that even with such soft material the resultant boots can meet the highest Mt75 impact classification.

21 Claims, 5 Drawing Sheets

METATARSAL PROTECTORS FOR FOOTWEAR

CROSS REFERENCE TO A RELATED APPLICATION

This application is a continuation-in-part of my prior application Ser. No. 09/517,556, filed Mar. 02, 2000, now abandoned.

FIELD OF THE INVENTION

This invention is concerned with improvements in or relating to metatarsal protectors used in footwear, particularly but not exclusively in safety footwear, namely boots and shoes that are worn in locations and for occupations and pastimes where there is danger of impact and/or compression forces being applied to and injuring the feet of the wearer.

BACKGROUND OF THE INVENTION

Many industries now require that workers wear safety footwear to protect their feet against injury caused, for example, by impacts from above caused by falling objects, or by compression such as may be caused by a vehicle wheel rolling over the foot. Footwear incorporating additional protective structures for the toes and/or metatarsal regions are also desirable in other applications, such as the sports of ice hockey and rock climbing, or when particularly dangerous equipment is being used, such as axes and chain saws.

The safety footwear that currently is available usually includes a toe protector, such as a steel toe box (sometimes called a box toe) providing a protective arch above the toes, through which any impact or compression force applied to its top surface is transmitted around the toes and through the boot or shoe to the ground. Increasingly provision is made to protect the metatarsal region including the five long bones of the instep that extend from the toes to the remainder of the bones of the foot. Many of the prior proposals for metatarsal protection comprise a guard that is fastened to the exterior of the boot or shoe, but increasingly for convenience, and to ensure that it must be worn, the protector is incorporated into the footwear.

The Occupational Health & Safety Association (OHSA) specifies test and performance standards that have been established by American National Standards Inc. (ANSI) which safety enhanced footwear must pass if they are to be certified by them. The Canadian Standards Association (CSA) have adopted equivalent standards. Metatarsal protectors are not required to pass a compression test, since the toe protector will usually provide all of the protection that is required. The test procedure for measuring impact force resistance involves dropping a standard weight on to the metatarsal portion of a specimen boot (size 9D for men and 8 B for women) at a point 8.9 cm (3.5 in) from the outside tip of the 9D boot toe and 8.6 cm (3.375 in) from the outside tip of the 8B boot, the weight being dropped from a height such that it has the required impact force on contact. Three different values of force are used, namely 101.7 Joules (75 foot pounds), 67.8 Joules (50 foot pounds), and 40.7 Joules (35 foot pounds). For certification the minimum clearance inside the boot after the test, as measured by a permanently compressible wax body under the impact point, must be at least 2.5 cm (1.0 in, usually expressed as 32/32 in) for the 9D boot and 2.4 cm (0.94 in, usually expressed as 30/32 in) for the 8B boot. Footwear meeting the corresponding one of these requirements is certified as meeting the standard Mt/75, Mt/50 or Mt/35 respectively.

At this time toe boxes are most usually made of steel, although toe boxes made of plastics materials are becoming available. Similarly, metatarsal protectors are made of both steel or plastics materials, and the plastics materials at present usually employed are for example high density polyethylene (HDPE) or polypropylene (HDPP), ABS and various proprietary nylons, since these are strong and are economical in price. Metatarsal protectors as currently proposed and as in use, of both metal and plastics materials, present a problem to the wearer arising from the fact that inherently they are very rigid, based on the belief to date that such rigidity is necessary for them to pass the test, and particularly to obtain the Mt75 certification. Although the two lower standards are available, in commercial practice most industries are only interested in purchasing footwear which will meet the highest Mt75 standard. Protectors which have resulted from this thinking are of such rigidity and/or thickness that it is difficult to make the boot sufficiently flexible, so as not to hinder walking or kneeling. One solution has been to make the protectors in several pieces that are hinged together, but this does of course considerably increase the cost. Another solution has been to form them with a plurality of longitudinally spaced, transversely extending slots extending inwards from each edge to leave a smaller, more flexible connection along the centre line. Such flexible connections are of course subject to fatigue breakage, but the average working life of a safety boot is relatively short and, even if they do break, hopefully the boot will still be usable.

SUMMARY OF THE INVENTION

It is therefore the principal object of the invention to provide a metatarsal protector that can readily be molded from flexible plastics materials and still meet the test requirements for certification as described above.

It is a another object to provide a metatarsal protector molded from flexible plastics material that is able meet the test requirements for certification as described above while being sufficiently flexible that it provides a minimum of hindrance to walking and kneeling.

It is a further object to provide a metatarsal protector molded from flexible plastics material that is able meet the test requirements for certification as described above, while being sufficiently thin that it can be incorporated into footwear without making it unduly bulky, as seen in side elevation.

In accordance with the present invention there is provided a metatarsal protector for footwear to protect the foot of a wearer from an impact force applied to the metatarsal region thereof, each such footwear comprising an upper having outer and inner surfaces and a sole having outer and inner surfaces, the upper and the sole having respective registering metatarsal regions and being joined to one another with their inner surfaces facing one another;

wherein the protector comprises a protector body having first and second opposite faces, the protector body when incorporated into the footwear being interposed between the registering metatarsal regions with its first surface adjacent to the upper inner surface;

wherein the protector body has two longitudinally extending sides and two transversely extending ends, and when so incorporated is of size to conform to and cover the metatarsal region and of saddle shape, the body first surface is transversely convex and longitudinally concave toward the upper inner surface, and the body second surface is transversely concave and longitudinally convex toward the sole inner surface; and wherein the protector body is molded from flexible, resilient plastics material and at least the central portion thereof has protruding from one surface thereof a plurality of ridged first projections providing a corresponding plurality of open-mouthed first recesses, each of which first recesses is surrounded by a respective first projection or immediately adjacent first projections that are joined together;

the material from which the protector body is molded has an overall hardness as measured by a Durometer A test of from 35 to 60 Shore; and the width and height dimensions of the first projections and the corresponding dimensions of the first recesses are such that an impact force applied to the footwear metatarsal region at an impact point results in an acceptable minimum clearance inside the footwear during and after the impact.

The protector body may be provided on the other surface thereof not having the first projections protruding therefrom with a plurality of second projections distributed thereover, the distribution of the second projections being such that they each register with a respective first recess. The shapes of the plurality of second projections may be the same as those of the first recesses and the sizes of the plurality of second projections may be not greater than those of the respective registering first recesses, so that they would fit within those recesses if presented thereto.

Preferably the width and height dimensions of the first projections and the corresponding dimensions of the first recesses, and the width and height dimensions of the second projections when provided, are such that an impact force of up to 35 foot pounds, more preferably of up to 50 foot pounds, and even more preferably of up to 75 foot pounds, applied to the footwear metatarsal region at an impact point results in a minimum clearance inside the footwear after the impact, as measured by a permanently compressible wax body under the impact point, of at least 2.5 cm for a 9 D boot and 2.4 cm for an 8 B boot.

DESCRIPTION OF THE DRAWINGS

Metatarsal protectors per se, and the combination of such metatarsal protectors with footwear in which they are incorporated, that are particular preferred embodiments of the invention will now be described, by way of example, with reference to the accompanying diagrammatic drawings, wherein.

DESCRIPTION OF THE PREFERRED EMBODIMENTS

Figure 1:
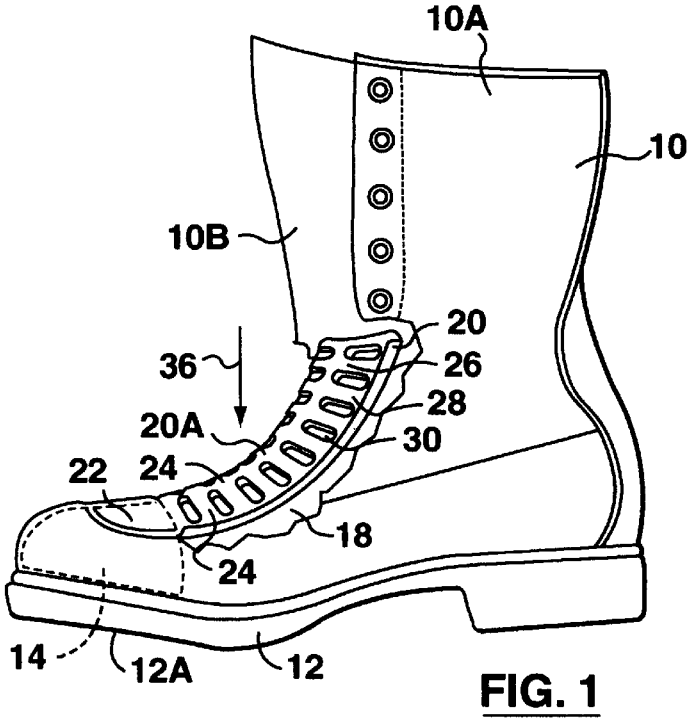
FIG. 1 is a side elevation of a safety boot, a part of the upper being shown broken away to show a metatarsal protector therein that is a first embodiment of the invention.
Figure 2:
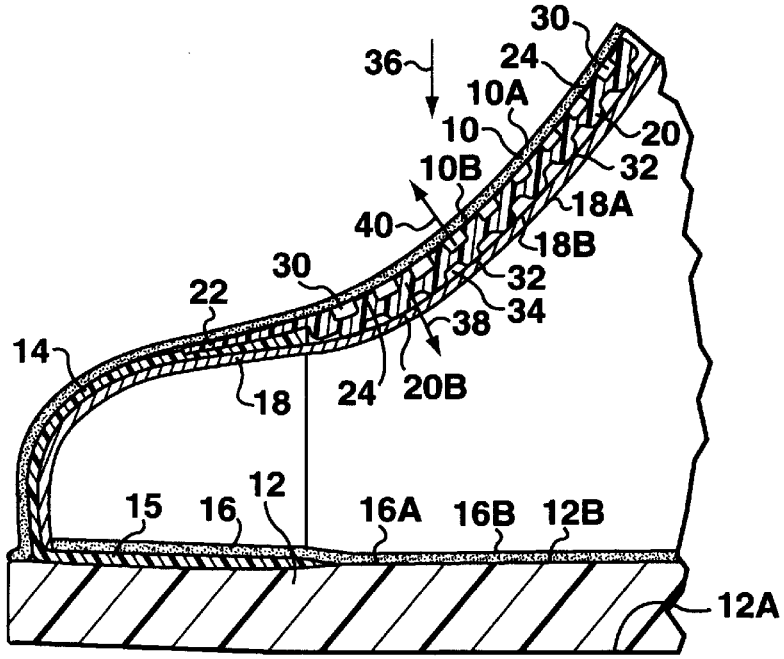
FIG. 2 is a longitudinal cross-section through the front part of the boot of FIG. 1, taken from the toe to the rear end of the protector.

Although for convenience the safety footwear shown in the drawings and described below is a safety boot, the invention is applicable equally to shoes and to all other types of footwear with which enhanced safety is required for the metatarsal region of the foot, and all such footwear is within the scope of the language of the claims. A boot or shoe usually comprises an upper attached to a composite sole structure comprising as a minimum an insole and an outsole; other structural elements such as a midsole and, in the case of safety footwear requiring the provision of such protection, a steel sole plate preventing penetration by nails and similar sharp objects, may be interposed between the insole and outsole. For convenience in the language used in the claims any such composite sole structure is referred to simply as the footwear sole whatever its actual structure. For convenience the outer surface of an element employs the same reference number as the element with the subscript A, while the corresponding inner surface reference has the subscript B.

Referring now to FIGS. 1–5, a typical safety boot comprises a boot upper 10 having respective outer and inner surfaces 10A and 10B, and an outsole 12 having respective outer and inner surfaces 12A and 12B, the upper and the outsole having respective toe regions that register with one another and respective metatarsal regions that register with one another. A toe box protector 14, which in this embodiment is of molded plastics material, is incorporated into the boot between the inner surface 10B of the boot upper and the inner surface 12B of the outsole. The toe box 14 is of usual shape comprising a generally U-shaped body with the ends of its side walls immediately adjacent to the outsole inner surface 12B connected together by an integrally molded bottom connecting portion 15 that butts against the outsole inner surface. Impact or compression forces applied to the toe protector are transmitted through the protector body to the ground. Toe boxes of plastics materials that are able to meet ANSI test requirements while being of size and shape that they can replace existing metal toe boxes are described and claimed in my U.S. Pat. No. 5,878,511, issued Mar. 9, 1999, and in my pending application Ser. No. 09/506,292, filed Feb. 18, 2000, the disclosures of which are incorporated herein by this reference.

An insole 16 lies against the inner surface 12B of the outsole and extends into the interior of the toe box. An inner lining 18 having an outer surface 18A and an inner surface 18B, and of a soft, pliable material, such as thin leather, cotton cloth, nylon cloth, etc., is fitted against the inner surface 10B of the upper, the inner surface of the toe box, and against the inner surface of a metatarsal protector 20, where this is interposed between the upper and the lining. The boot may comprise other functional parts, such as a midsole between the insole and outsole, and a metal or plastics material plate covering the instep to protect against penetration by spikes, but such other parts are not pertinent to the present invention and are not illustrated, the manner in which they may be incorporated into footwear being well known to those skilled in this particular art.

Figure 3:
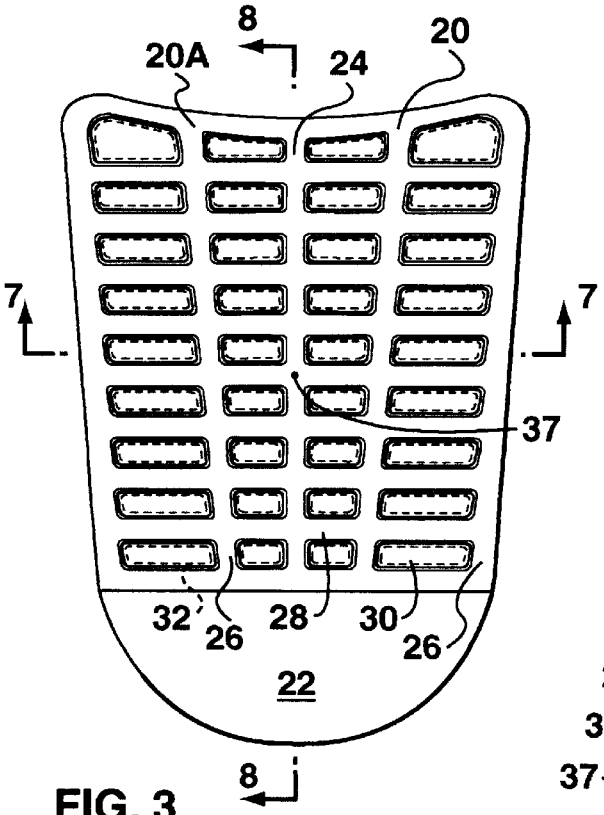
FIG. 3 is a plan view of the protector in flat configuration as molded and before its incorporation into a boot.
Figure 4:
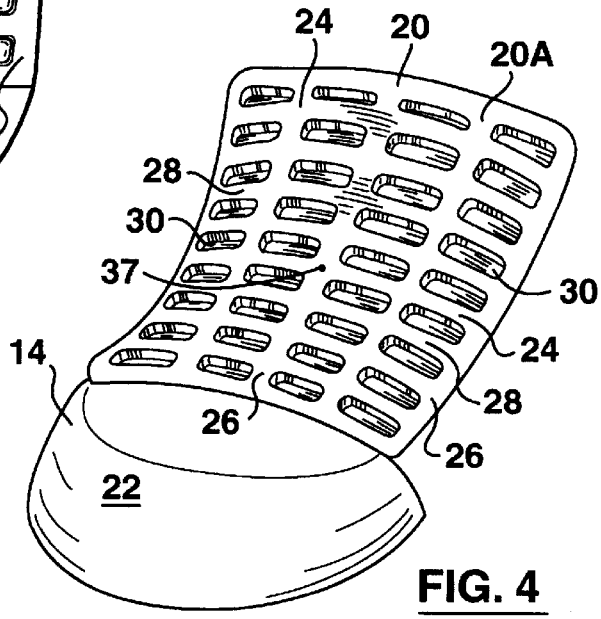
FIG. 4 is perspective view of the protector of FIGS. 1–3, in combination with a toe box protector, the view being taken from above and from the front in order to show most clearly the outer surface of the protector facing the inner surface of the boot upper.

The metatarsal protector 20 comprises a body molded from flexible, resilient plastics material, so that its hindrance to walking and kneeling is minimized, and consequently it has the potential of being more comfortable than one of metal or rigid plastics material. The employment of such a material also provides a considerable commercial manufacturing advantage over rigid metatarsal protectors in that it can be molded in a flat shape, as shown in FIG. 3, so that the molds required are of simpler and less expensive form, and moreover it is less expensive to pack and ship to the footwear manufacturer. During manufacture, when the protector body is interposed between the registering metatarsal regions of the upper and sole, it is bent to a saddle shape in which will closely embrace and cover the metatarsal portion of the wearer's foot. Thus, the body when bent and ready for such incorporation has an outer surface 20A that is convex transversely of the body and concave longitudinally toward the upper inner surface 10B, and an inner surface 20B that is concave transversely and convex longitudinally toward the inner surfaces 12B and 16B respectively of the outsole 12 and the insole 16. The body comprises a tongue member 22 extending from the end thereof adjacent to the toe box protector 14 and laid over the outer surface of the toe box protector body; the tongue will usually be attached to the toe box, as for example by cementing them together.

The protector body 20 comprises at one surface, which in this embodiment is its outer surface 20A, a plurality of integral molded rectangular shaped ridged first projections 24, each of which is integrally joined with its two immediately adjacent ridged first projections to form a first set of transversely spaced, longitudinally extending parallel ridges, identified in FIG. 3 by the secondary reference 26. The integrally joined first projections also form a second set of longitudinally spaced, transversely extending parallel ridges given the supplementary reference 28, in this embodiment the two sets of ridges intersecting at right angles to form a rectangular grid pattern as seen in plan and forming between them a corresponding plurality of rectangular open-mouthed recesses 30, each of which is surrounded by respective portions of the two sets of ridges, and whose function will be described below. The ridge portions of these first projections 24 lie in and determine the outer surface 20A of the protector body, so that when the protector is incorporated into a boot they will contact the inner surface 10B of the upper.

The protector body 20 is also provided on the opposite side to that having the first projections 24, namely the inner surface 20B thereof facing the sole 12, with a plurality of second ridged projections 32, the ridge portions of which lie in and determine the inner surface 20B of the protector body and engage the inner surface 18B of the lining. These projections are all separate and spaced from one another and their disposition is such that they each register with a respective one of the rectangular recesses 30, forming a corresponding rectangular grid of spaces between them. They are of about the same shape as the recesses 30, and are of the same size, or slightly smaller, so that they could fit within those recesses, if presented to them.

The usual impact point for the metatarsal impact test is indicated in FIG. 1 by the arrow 36, and in other of the Figures by point 37. Any such impact force is applied to the resilient material of the body and deforms it in a special manner that is characteristic of the invention. Thus, the impact force acting on the first projections 24 flexes and deforms them and the adjacent parts of the body downward, so that the projections are urged downward in the direction of the arrow 38 (FIG. 2) into the spaces between the second projections 32. Simultaneously, the reaction from the inner lining 18 of the same force acting on the second projections 32 flexes and deforms the adjacent parts of the body, so that the second projections 32 are urged upward in the direction of the arrow 40 in FIG. 2 into the individual open-mouthed first recesses 30. These flexions and deformations result in absorption of sufficient of the impact force that the remaining amount that is transmitted through the protector and applied to the wearer's foot is within the limits required for the boot to be certified with at least the classification Mt30, and certification has already been obtained with the maximum classification Mt75, as will be described below. This is an unexpected result in that it appears to have been the usual belief hitherto that the protector must be of metal or a rigid plastics material if such certification was to be obtainable.

The protectors of the invention therefore differ completely from the rigid metatarsal protectors that have been used and proposed hitherto in that there is no attempt to completely resist the impact force, but instead a structure is provided which has proven capable of absorbing sufficient of the impact force that safety for the wearer's foot can be provided within a practical limit, as set by the impact tests employed for official certification. A most important result of this approach is that it has proven possible to provide a metatarsal protector that, while meeting the onerous safety requirement of the test procedures, is sufficiently thin and flexible to be incorporated readily into a boot, and when so incorporated permits the wearer to walk and kneel in normal usage. It will be noted that the ridge portions of both of the first and second projections 24 and 32 respectively are rounded in transverse cross section, and it is believed that this rounding does assist in ensuring that a protector that is sufficiently thin to still be flexible is able to provide sufficient resistance to the applied impact force, the rounding providing progressive increase of resistance of the body to the impact force and corresponding progressive absorption of the impact force by the material of the body.

Each rectangular shaped first projection 24 in this embodiment has two longer parallel sides and two shorter parallel sides and is joined shorter end to shorter end with its two immediately adjacent projections to form its respective ridge 26 or 28. The recesses 30 formed between the ridges 26 and 28 have transverse dimensions that are greater than their longitudinal dimensions, with the result that the transverse flexibility of the body is greater than its longitudinal flexibility to meet the requirement that the curvature transversely is greater than longitudinally. In this embodiment the two longitudinally extending sides of the body are each provided with a respective longitudinally extending side ridge 26, and the other longitudinally extending ridges 26 that are provided are disposed between these two side ridges with their transverse spacing decreasing toward the longitudinal centre body line of the body, so that the projections forming the ridges are closer together toward the centre of the body and its usual impact point 37, thereby increasing the impact absorption of the body toward its centre. In this embodiment the body is of uniform thickness along its length and, in order to be more easily incorporated into the boot, tapers downward in width decreasing from the transverse end further from the toe to the transverse end nearer to the toe.

Protectors as illustrated by FIGS. 1–4 in a men's 9D size boot were successfully tested to the Mt75 rating. The protector body was of 15 cm (6 ins)length overall while the tongue was 3.8 cm (1.5 ins) in length; the width of the body at the end further from the toe was 11.5 cm (4.5 ins) while its width at the end closer to the toe was 9.5 cm (3.75 ins). The body was of uniform thickness 11 mm (0.43 in) throughout its length with of course the exception of the tongue which was 1 mm (0.04 in) thick. The ridges 26 and 28 were all of constant width 7 mm (0.275 in), and the recesses 30 were also of constant width in the longitudinal direction and of the same width as the ridges. The transverse width of the recesses 30 between the longitudinal side ridges and their immediately adjacent longitudinal ridges was 23 mm (0.875 in), while the recesses toward the centre of the body reduced in transverse width from 19 mm (0.75 in) at the wider top end to 11 mm (0.43 in) at the narrower end adjacent the toe box to take account of the reduction in width of the body. The recesses were all of the same depth, namely 5 mm (0.2 in), which is of course also the height of the projections. The projections 32 are all of the same height, namely 2.5 mm (0.1 in) and the transverse width of those at the edges of the body was constant at 21 mm (0.825 in) while those toward the centre reduced progressively in transverse width, as with the recesses 30, from 18 mm (0.70 in) at the end further from the toe to 10 mm (0.40 in) at the end nearer the toe, so that as desired they can fit snugly into the recesses 30 if required.

Two sample boots were tested and achieved clearances beneath the impact point 37 above the minimum requirement for Mt75 of 32/32 in. Both protectors were manufactured from TPR thermoplastic rubber which is sold by a number of different manufacturers. The embodiment was molded as a single integral body, resulting in a protector body that, when tested for hardness did show, as is usual, variations owing to the usual manufacturing tolerances. Thus, when a group of seventeen samples chosen at random were tested with a Type A Durometer, their hardness measured between 40 and 45 Shore as follows:

Three samples gave a reading of 40 Shore;

Three samples gave a reading of 41 Shore;

Four samples gave a reading of 42 Shore;

One sample gave a reading of 43 Shore;

Two samples gave a reading of 44 Shore;

Four samples gave a reading of 45 Shore.

Figure 5:
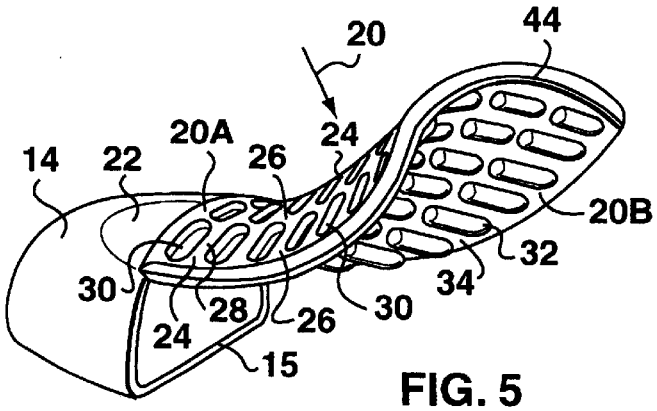
FIG. 5 is another perspective view of the combination of FIG. 4, taken from one side and from the rear so as to show most clearly the inner surface of the protector facing the inner surface of the boot sole.

Other materials will of course give different values and different ranges of values and will require adjustment of the thickness, size shape and disposition of the first and second ridged projections. For example, prior embodiments were manufactured from a polyurethane resin VX179 sold by Valthane Corp, using an isocyanate activator 2240 sold by Dow Chemical; this particular resin has a blowing or foaming agent incorporated therein and those that do not include such an agent will require one to be added. These polyurethane materials inherently are somewhat stiffer than TPR rubber, and a protector molded as a single integral body resulted in a protector that when tested with a Type A Durometer measured between 55 and 60 Shore on the side with the projections 24, and between 60 and 65 Shore on the side with the projections 32. Another protector was molded from polyurethane in two separate parts which were then cemented together along a part line 44, as shown in FIG. 5. The molding procedures used for the two parts differed in the time before the mold was fully closed, with the result that the hardness of the two parts differed more than with the first-mentioned protector. Thus, the composite body measured between 35 and 40 Shore on the side with the projections 24, and between 68 and 69 Shore on the side with the projections 32, the resulting "composite" or "overall" hardness lying between these two sets of values.

It will be seen therefore it is necessary to use materials within a relatively narrow range of hardness, a body with a composite or overall hardness characteristic of between 35 and 60 Shore being necessary, the preferred maximum being 50 Shore. It is considered that the minimum value of 35 Shore is necessary to ensure that the protector will be able to absorb sufficient of the impact force, so that it will meet the test requirements for certification, while the maximum composite or overall value of 60 Shore is required to ensure that the protector is sufficiently flexible to be bent to the required shape, and to give the desired flexibility in walking and kneeling. As indicated by the second and third examples above, the body can differ in hardness and flexibility throughout as long as the overall characteristic is obtained, and there are a number of ways of obtaining differences in hardness, for example by control of the curing process, the degree to which the plastics material is expanded during the process, and by differential heating of the mold cavity during the process. There is a wide range of flexible, resilient moldable materials that can be used in the production of the protectors of the invention, all of which will need to be expanded or blown to attain the necessary flexibility, resulting in either open or closed cell materials. Examples of specific materials are polyurethane esters or ethers (the esters generally are more chemically resistant), thermal plastic urethanes (TPU), polyvinyl chlorides, and rubber compounds, particularly those identified as TPR, EVA and EPDM. If desired all of these materials may be reinforced with glass or carbon fibre.

Figure 6:
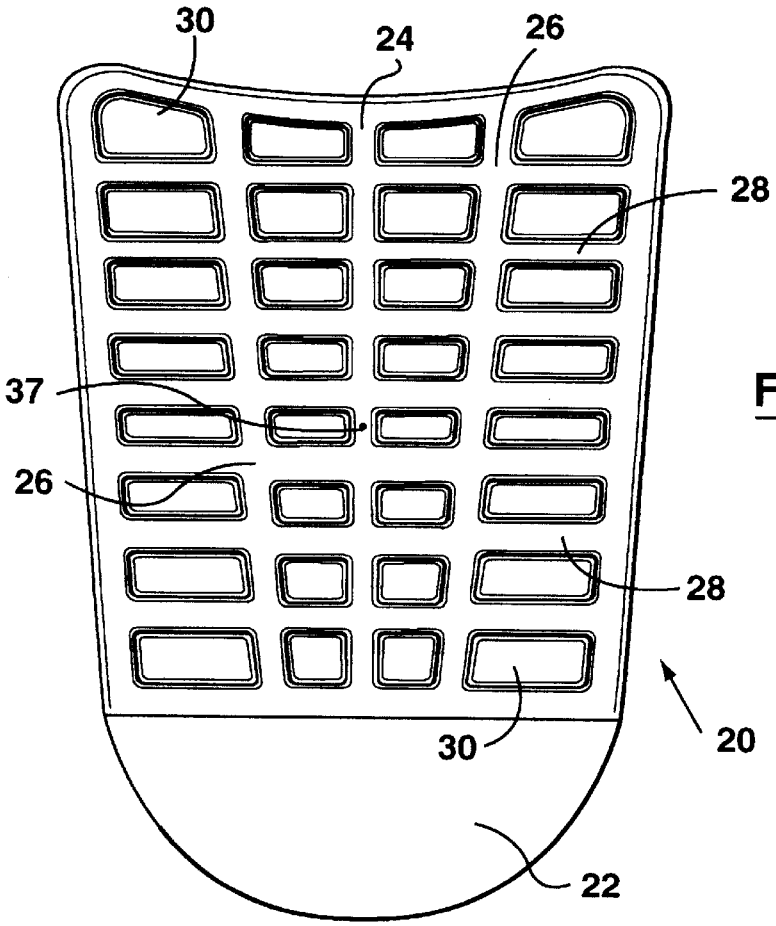
FIG. 6 is a plan view similar to FIG. 3 illustrating another embodiment.
Figure 7:
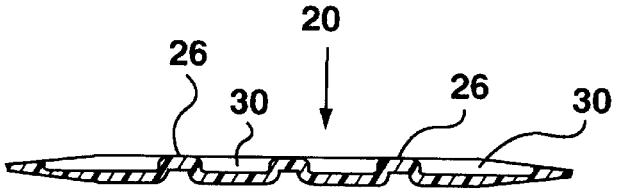
FIGS. 7 and 8 are cross sections taken on the lines 7—7 and 8—8 respectively in FIG. 3, but showing a further embodiment.
Figure 8:
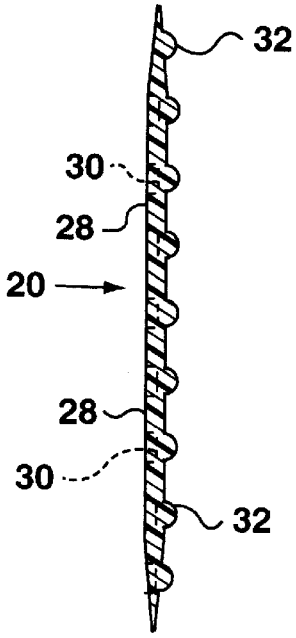

FIG. 6 illustrates an embodiment similar to that of FIGS. 1–5, but in which the spacing of immediately adjacent transverse ridges 28 of the corresponding sets of transverse first projections 24 also decreases toward the centre portion of the protector body, as with the longitudinal ridges 26, to provide increasing flexibility toward its edges as well as towards its sides, while maximizing the impact absorption of the protector body at the impact point 37 at its centre portion. FIGS. 7 and 8 are sections through another embodiment in which the protector body is not uniform in thickness, but reduces in thickness both toward its edges (see FIG. 7) and toward its sides (see FIG. 8) to minimize the use of material, while retaining sufficient impact absorption at the center portion, and providing additional flexibility toward its edges and sides.

Figure 9:
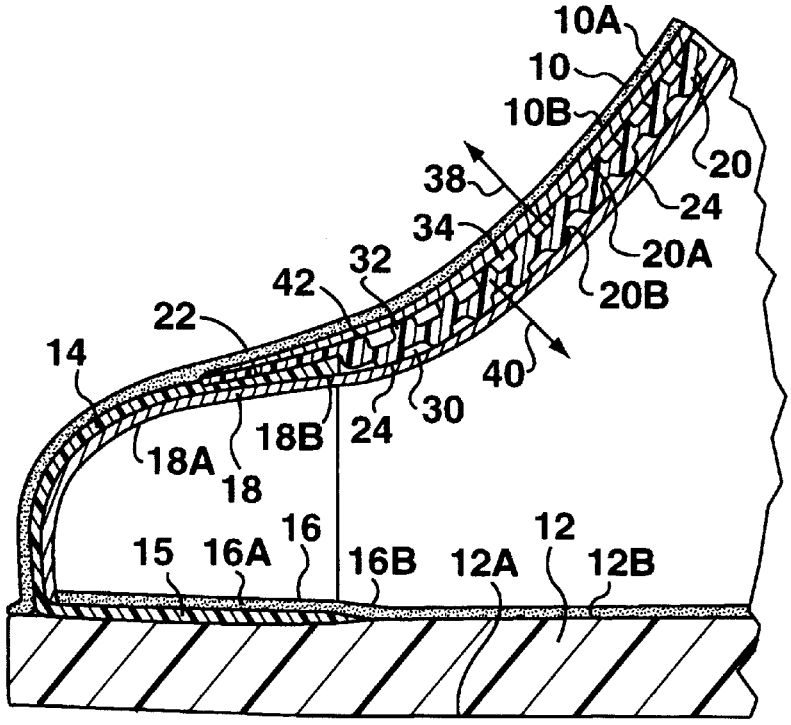
FIG. 9 is a longitudinal cross-section similar to FIG. 2 to show a further embodiment in which the protector of FIGS. 1–3 is inverted for its incorporation into the boot, and in which the protector is supplemented by the addition of a penetration resistant layer.

FIG. 9 illustrates a further embodiment in which the protector body 20 as described above is inverted so that it is the ridge portions of the grid of ridge projections 24 and the corresponding recesses or cells 30 that lie in and define the body inner surface 20B, while the ridge portions of the plurality of individual projections 32, and the grid-like space they provide lie in and define the outer surface 20A and are disposed facing and adjacent to the inner surface 10B of the boot upper. The thin tongue 22 has been moved to the opposite edge of the end face so that it can be applied to the outer surface of the toe box 14 without causing a visible bump at the junction.

In addition, in this embodiment a thin layer 42 of an impact resistant material, such as the composite plastic material sold under the Trademark "KEVLAR" and commonly used for example for bulletproof vests, is interposed between the protector 20 and the upper 10 to provide increased puncture resistance, since the flexible materials employed in the invention cannot provide much such puncture protection.

Figure 10:
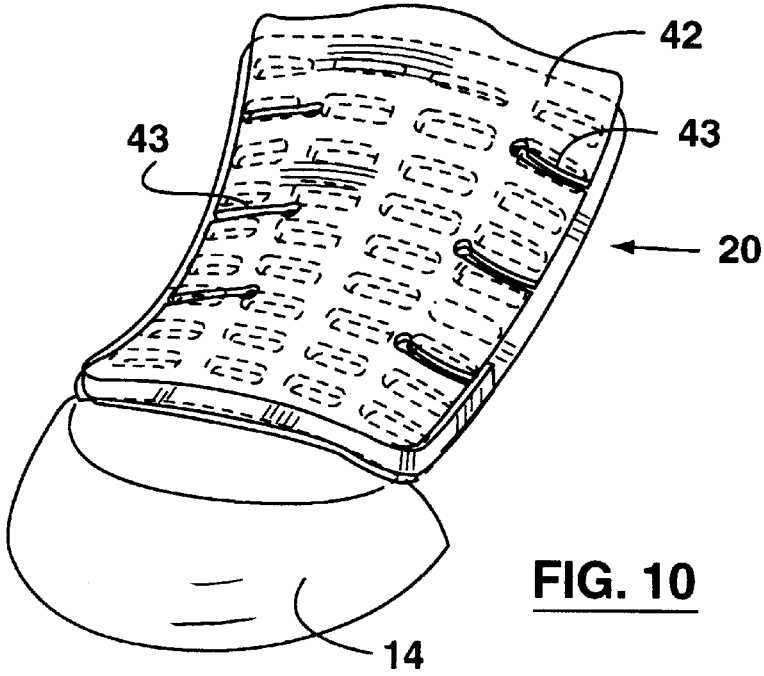
FIG. 10 is a perspective view similar to FIG. 4 to show the combination of the protector with a penetration resistant layer.

FIG. 10 shows an embodiment in which the additional layer 42 is molded from a comparatively rigid material, it being thin and provided with longitudinally spaced transverse slots 43 to provide as much flexibility as possible, so as not to reduce the flexibility of the resulting composite protector body more than is necessary. Even if the puncture resistance provided thereby is not absolutely necessary, it is found with some markets that the provision of such a thin layer of any more rigid plastics material is desirable as a selling aid, since many customers are reassured by its presence that the protector does have adequate impact resistance, even with protectors which are certifiable without the added layer.

Figure 11:
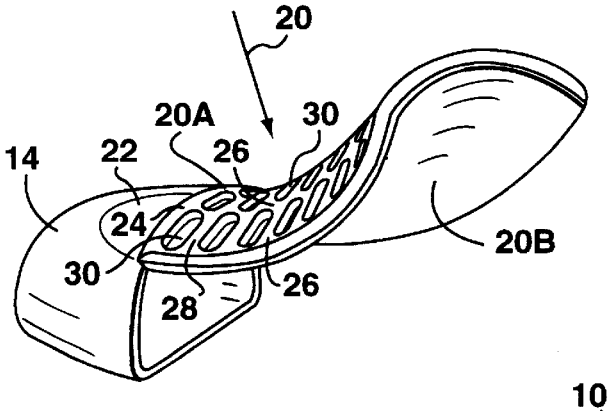
FIG. 11 is a perspective view similar to FIG. 5 to show a further embodiment.

FIG. 11 shows a further embodiment in which the protector body 20 has only a plurality of ridged first projections 24 at one surface thereof, shown in this embodiment as ridge forming projections 24 surrounding recesses 30, the ridges again comprising two straight sets 26 and 28 intersecting one another at right angles. With proper choice of materials and dimensions, particularly the thickness of the body 20, such an embodiment may be all that is required to obtain a certification of Mt30, or even Mt50, if such a lower rating is all that is required, and in the absence of the second set of projections 32 the body can be made correspondingly thinner.

Figure 12:
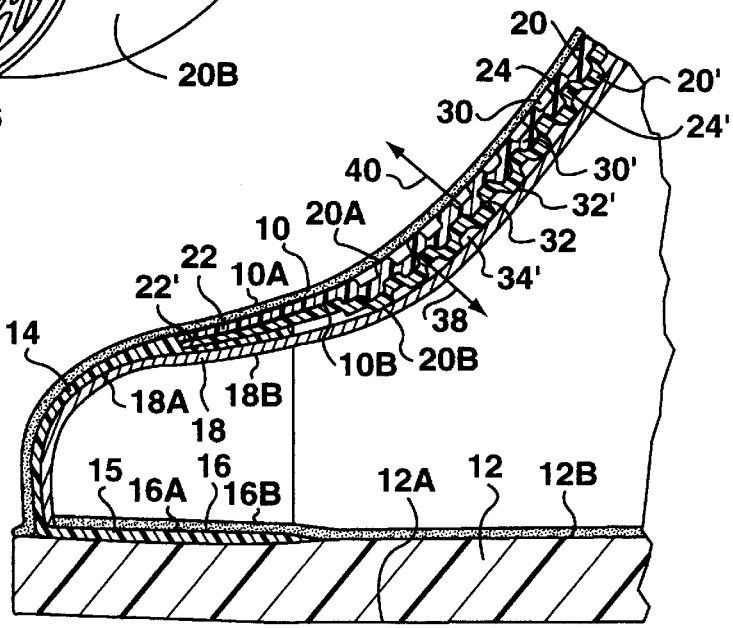
FIG. 12 is a longitudinal cross-section similar to FIGS. 2 and 9 to show an embodiment in which two separate protector bodies are nested together to provide increased impact force protection.

FIG. 12 shows a protector incorporated in a boot wherein advantage is taken of the fact that the shape, dimensions and disposition of the second projections 32 are such that they can fit within the first recesses or cells 30, thereby enabling two separate protector bodies to be incorporated into a safety boot with one nested in the other to form a composite protector. For clarity in illustration the references employed for the second body are the same as for the first body but with ' as a suffix, e.g. 20', 30', 32', etc.

Figure 13:
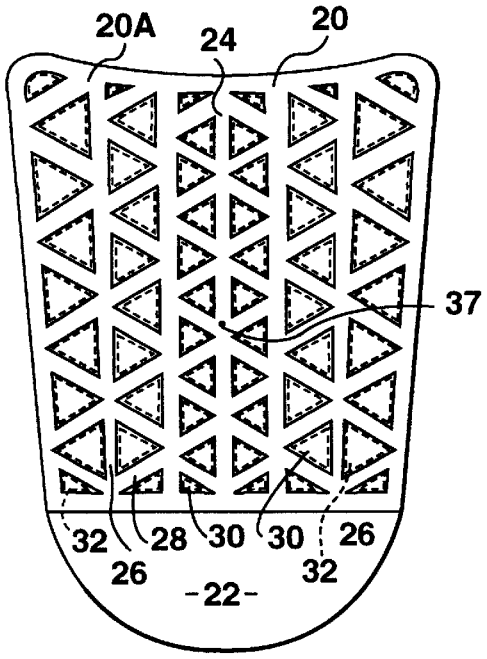
FIG. 13 is a plan view similar to FIG. 3 to show a further embodiment in which projections from one surface of the protector are ridges enclosing triangular recesses and the projections from the other surface are triangular as seen in plan.

FIG. 13 is a plan view similar to FIG. 3 of a protector in flat configuration that is a further embodiment. The ridged projections 24 whose ridge portions define the body outer surface 20A are again joined end-to-end to form sets of continuous ridges 26 and 28. The sets 24 are again longitudinally extending and transversely spaced, with the spacing decreasing toward the center, but the sets 28 are inclined at acute angles (or at complementary obtuse angles) to the sets 26, with the result that the recesses 30 are triangular in plan. The projections 32 from the second surface 20B are also triangular in cross section, and of dimensions such that they would be able to fit within the recesses 30 if two protector bodies are placed face-to-face. Such an embodiment has an advantage in that the majority of the flexing to which the protector is subjected during walking and kneeling is transversely thereof, with the possibility of the production of transverse fatigue cracks in the material. The production of such cracks should be lessened with the inclined sets of ridges 28.

Figure 14:
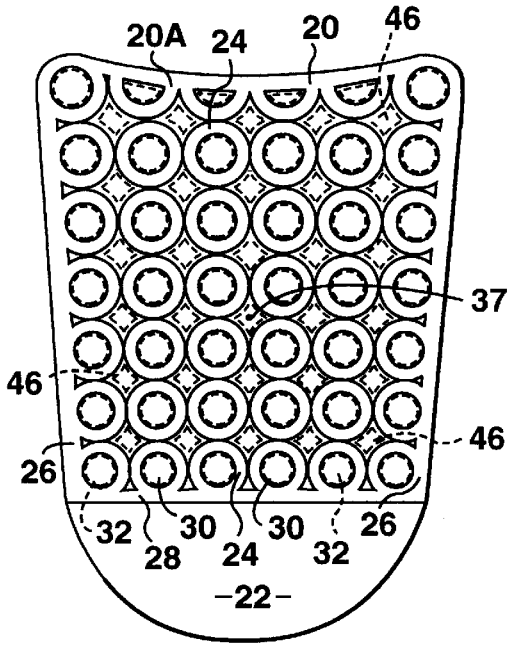
FIG. 14 is also a plan view similar to FIG. 3 to show a yet further embodiment in which projections from one surface of the protector are annular ridges enclosing circular recesses and the projections from the other surface are circular cross section columns as seen in plan.

FIG. 14 is also a plan view similar to FIG. 3 to show a yet further embodiment in which the ridged projections 24 are each of annular cross section surrounding circular recesses 30, while the projections 32 are circular cross section columns as seen in plan. In the event that the columnar projections 30 do not provide sufficient impact absorption, they can be supplemented, as shown, by providing a second plurality of spaced fluted cross section projections 46 that register with the correspondingly shaped spaces between the annuli 24.

I claim:

1. A metatarsal protector for footwear to protect the foot of a wearer from an impact force applied to the metatarsal region thereof, each such footwear comprising an upper having outer and inner surfaces and a sole having outer and inner surfaces, the upper and the sole having respective registering metatarsal regions and being joined to one another with their inner surfaces facing one another;

wherein the protector comprises a protector body having first and second opposite faces, the protector body when incorporated into the footwear being interposed between the registering metatarsal regions with its first surface adjacent to the upper inner surface;

wherein the protector body has two longitudinally extending sides and two transversely extending ends, and when so incorporated is of size to conform to and cover the metatarsal region and of saddle shape, the body first surface is transversely convex and longitudinally concave toward the upper inner surface, and the body second surface is transversely concave and longitudinally convex toward the sole inner surface;

wherein the protector body is molded from flexible, resilient plastics material and at least the central portion thereof has protruding from one surface thereof a plurality of ridged first projections providing a corresponding plurality of open-mouthed first recesses, each of which first recesses is surrounded by a respective first projection or immediately adjacent first projections that are joined together;

the material from which the protector body is molded has an overall hardness as measured by a Durometer A test of from 35 to 60 Shore; and the width and height dimensions of the first projections and the corresponding dimensions of the first recesses are such that an impact force of up to 35 foot pounds applied to the footwear metatarsal region at an impact point results in a minimum clearance inside the footwear after the impact, as measured by a permanently compressible wax body under the impact point, of at least 2.5 cm for a 9D boot and 2.4 cm for an 8B boot.

2. A protector as claimed in claim 1, wherein the protector body is provided on the other surface thereof not having the first projections protruding therefrom with a plurality of second projections distributed thereover, the distribution of the second projections being such that they each register with a respective first recess; and wherein the width and height dimensions of the first projections, and the width and height dimensions of the second projections, are such that an impact force of up to 35 foot pounds applied to the footwear metatarsal region at an impact point results in a minimum clearance inside the footwear after the impact, as measured by a permanently compressible wax body under the impact point, of at least 2.5 cm. for a 9D boot and 2.4 cm. for an 8B boot.

3. A protector as claimed in claim 1, characterized in that the width and height dimensions of the first projections and the corresponding dimensions of the first recesses are such that an impact force of up to 50 foot pounds applied to the footwear metatarsal region at an impact point results in a minimum clearance inside the footwear after the impact, as measured by a permanently compressible wax body under the impact point, of at least 2.5 cm for a 9D boot and 2.4 cm for an 8B boot.

4. A protector as claimed in claim 1, characterized in that the width and height dimensions of the first projections and the corresponding dimensions of the first recesses are such that an impact force of up to 75 foot pounds applied to the footwear metatarsal region at an impact point results in a minimum clearance inside the footwear after the impact, as measured by a permanently compressible wax body under the impact point, of at least 2.5 cm for a 9D boot and 2.4 cm for an 8B boot.

5. A protector as claimed in claim 2, characterized in that the width and height dimensions of the first projections and the corresponding dimensions of the first recesses, and the width and height dimensions of the second projections, are such that an impact force of up to 50 foot pounds applied to the footwear metatarsal region at an impact point results in a minimum clearance inside the footwear after the impact, as measured by a permanently compressible wax body under the impact point, of at least 2.5 cm for a 9D boot and 2.4 cm for an 8B boot.

6. A protector as claimed in claim 2, characterized in that the width and height dimensions of the first projections and the corresponding dimensions of the first recesses, and the width and height dimensions of the second projections, are such that an impact force of up to 75 foot pounds.

7. A protector as claimed in claim 2, wherein the shapes of the plurality of second projections are the same as those of the first recesses and the sizes of the plurality of second projections are not greater than those of the respective registering first recesses.

8. A protector as claimed in claim 7, and comprising two separate protector bodies disposed with the first surface of one against the second surface of the other and with the second plurality of projections of one protruding into the recesses of the other.

9. A protector as claimed in claim 1, wherein the protector body comprises a tongue member extending from the transverse end thereof that when the protector is incorporated into footwear is adjacent to a toe box protector, so that when so incorporated it can extend over a surface of the toe box protector and be attached thereto.

10. A protector as claimed in claim 2, wherein the protector body comprises a tongue member extending from the transverse end thereof that when the protector is incorporated into footwear is adjacent to a toe box protector, so that when so incorporated it can extend over a surface of the toe box protector and be attached thereto.

11. A protector as claimed in claim 1, wherein the ridge portions of the plurality of first projections are rounded to provide progressive absorption of an impact force by the material of the body.

12. A protector as claimed in claim 2, wherein the ridge portions of the pluralities of both first and second projections are rounded to provide progressive absorption of the impact force by the material of the body.

13. A protector as claimed in claim 1, wherein the spacing of immediately adjacent first projections from one another decreases toward the centre portion of the protector body to maximize the impact absorption of the protector body at its centre portion.

14. A protector as claimed in claim 1, wherein each first projection is joined with immediately adjacent first projections to form a first set of spaced parallel ridges and a second set of spaced parallel ridges extending transversely of the first set, the two sets intersecting at right angles to form between them a corresponding plurality of first recesses of rectangular cross section.

15. A protector as claimed in claim 2, wherein each first projection is joined with immediately adjacent first projections to form a first set of spaced parallel ridges and a second set of spaced parallel ridges extending transversely of the first set, the two sets intersecting at right angles to form between them a corresponding plurality of first recesses of rectangular cross section; and wherein each second projection is also of rectangular cross section and registers with a respective first recess, its dimensions being such that it could fit within the respective first recess.

16. A protector as claimed in claim 1, wherein each first projection is joined with immediately adjacent projections to form a first set and a second set of spaced ridges, the two sets intersecting at acute angles and complementary obtuse angles to form between them a corresponding plurality of first recesses of triangular cross section.

17. A protector as claimed in claim 2, wherein each first projection is joined with immediately adjacent projections to form a first set and a second set of spaced ridges, the two sets intersecting at acute angles and complementary obtuse angles to form between them a corresponding plurality of first recesses of triangular cross section; and wherein each second projection is also of triangular cross section and registers with a respective first recess, the dimensions of each second projection being such that it could fit within the respective first recess.

18. A protector as claimed in claim 1, wherein each first projection is of annular cross section, each surrounds a respective first recess of circular cross section, and each borders a fluted cross section recess between itself and the immediately adjacent annular first projections.

19. A protector as claimed in claim 2, wherein each first projection is of annular cross section, each surrounds a respective first recess of circular cross section, and each borders a fluted cross section recess between itself and the immediately adjacent annular first projections; and wherein each second projection is of circular cross section and registers with a respective first recess, and there are provided with the second projections further projections of fluted cross section, each registering with a respective recess of fluted cross section, the dimensions of the second projections being such that they could fit within the first recesses.

20. A protector as claimed in claim 1, wherein the protector body comprises for interposition between itself and the footwear upper a layer of a more penetration resistant plastics material to increase the overall penetration resistance of the footwear in which it is incorporated.

21. A protector as claimed in claim 2, wherein the protector body comprises for interposition between itself and the footwear upper a layer of a more penetration resistant plastics material to increase the overall penetration resistance of the footwear in which it is incorporated.

* * * * *